US006220889B1

(12) United States Patent
Ely et al.

(10) Patent No.: US 6,220,889 B1
(45) Date of Patent: Apr. 24, 2001

(54) ADJUSTABLE CABLE EGRESS MECHANISM FOR CABLE CONNECTORS

(75) Inventors: Steven Barry Ely, Lilburn, GA (US); Jerry Lee Glenn, Omaha, NE (US); Paul John Straub, Mooresville; Cherie L. Wolfe, Greenwood, both of IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/356,665

(22) Filed: Jul. 19, 1999

(51) Int. Cl.[7] ..... H01R 13/56
(52) U.S. Cl. ..... 439/446; 439/310
(58) Field of Search ..... 439/446, 13, 23, 439/310; 248/52

(56) References Cited

U.S. PATENT DOCUMENTS 3,794,960 2/1974 Sugar .
4,761,145 8/1988 Goto et al. .
4,959,021 * 9/1990 Byrne ..... 439/310
5,366,187 * 11/1994 Ishihara ..... 248/52
5,390,433 * 2/1995 Brady ..... 38/79
5,735,707 * 4/1998 O'Groske et al. ..... 439/446

FOREIGN PATENT DOCUMENTS 2 085 242 * 4/1982 (GB) .

* cited by examiner

*Primary Examiner*—Paula Bradley
*Assistant Examiner*—James R. Harvey
(74) *Attorney, Agent, or Firm*—Law Office of Leo Zucker

(57) ABSTRACT

An adjustable cable egress mechanism for cable connectors. The mechanism includes a protective hood, and a hub mounted inside the hood for rotation about a hub axis. The hub has a cable passage, and the hood has an outside wall with an elongated cable egress slot. The egress slot opens into the cable passage in the hub over a predetermined range of angular positions of the hub. Thus, a cable whose conductors terminate in an associated connector can be routed through the egress slot in the hood and the cable passage in the hub, and the cable rotated with the hub to a desired egress angle within the predetermined range. In the illustrated embodiment, the finger hub is engaged by latch formed on part of the hood to hold the cable at the desired egress angle.

24 Claims, 4 Drawing Sheets

ADJUSTABLE CABLE EGRESS MECHANISM FOR CABLE CONNECTORS

BACKGROUND OF THE INVENTION

1. Field of the Invention

This invention relates generally to cable connectors for cables used in voice and data communication systems.

2. Discussion of the Known Art

Industry standard "Category 5" cables comprise 25 unshielded twisted pairs (UTP) of insulated wires for carrying voice and data signals. These cables are quite rigid and difficult to bend. Thus, it becomes difficult if not impossible for a customer always to be able to route such cables conveniently in various applications where space is limited. When a number of typical 25-wire pair connectors associated with such cables are mounted in close proximity to one another, as normally occurs in the field, the stiffness of the cables makes their routing near the connectors especially troublesome.

In an attempt to meet different user applications, various connector arrangements have been proposed that offer the user a limited number of options with respect to cable egress angle relative to a connector body. This requires the user to determine beforehand which angle or angles are best suited for a particular application, however. Also, suppliers of such connectors must inventory a number of different cable connector/cable assemblies, so as to accommodate user requests for a particular plug connector type and cable length.

U.S. Pat. No. 3,794,960 issued Feb. 26, 1974, discloses an electrical connector junction shell that supports a cable which exits from an associated connector with an in-line or "straight up" configuration (i.e., at an angle of 180 degrees with respect to the direction in which the connector faces), or at a right angle (90 degrees) with respect to the direction of the connector face. As mentioned, applications exist where cable egress angles other than 180 or 90 degrees may be desirable to satisfy installations where a number of connectors are mounted close to one another and space for routing of the connector cables is limited.

Further, U.S. Pat. No. 4,761,145 issued Aug. 2, 1988, shows an electrical connector with a housing that has three openings facing in different directions through which wires can exit in a selected direction. To change the egress direction, it is necessary to disassemble the connector housing, redirect the wires through a different opening, and to clamp the wires with a clamp piece and an actuating screw.

Accordingly, the known connector housings or shells do not permit wires or cables to be set conveniently at a desired egress angle to meet the needs of various installations where angles ranging from, for example, 110 to 240 degrees may be required.

SUMMARY OF THE INVENTION

According to the invention, an adjustable cable egress mechanism for cable connectors includes a protective hood, and a supporting hub that is mounted within the hood for rotation about a hub axis. The hub has a cable passage, and the hood has an outside wall with a cable egress slot. The egress slot is formed in the hood to open into the cable passage in the hub, over a predetermined range of angular positions of the hub about the hub axis. Thus, an outside cable passing through the cable egress slot and extending in the cable passage in the hub can be rotated with the hub about the hub axis and supported by the hub at a desired egress angle within the predetermined range.

According to another aspect of the invention, a cable connector comprises a connector body having a terminal face for engaging terminals of a mating connector, and a cable end face for terminating cable conductors, diverging from a cable end of an outside cable. A hood is constructed and arranged for protectively enclosing the conductors and the cable in the region of the cable end face of the connector body, and a hub is mounted for rotation about a hub axis within the hood, the hub having a cable passage. The hood has a wall with a cable egress slot formed to open into the cable passage in the hub over a range of angular positions about the hub axis. Thus, an outside cable passing through the egress slot in the hood and extending in the passage in the hub, can be rotated with and supported by the hub at a desired egress angle within the mentioned range.

According to another aspect of the invention, a cable assembly includes a length of cable having a cable end, and a number of cable conductors diverging from the cable end. The assembly also includes a connector body having a terminal face, and a cable end face for terminating cable conductors from the cable end. A hood is constructed and arranged for protectively enclosing the conductors and the cable near the cable end face of the connector body, and a hub is mounted within the hood for rotation about a hub axis, the hub having a cable passage. A wall of the hood has a cable egress slot formed to open into the cable passage in the hub over a certain range of angular positions about the hub axis, and the cable passes through the cable egress slot in the hood and extends in the cable passage in the hub, so that the cable may rotate with the hub about the hub axis and be supported by the hub at a desired egress angle within the mentioned range.

For a better understanding of the invention, reference is made to the following description taken in conjunction with the accompanying drawing and the appended claims.

DETAILED DESCRIPTION OF THE INVENTION

Figure 1:
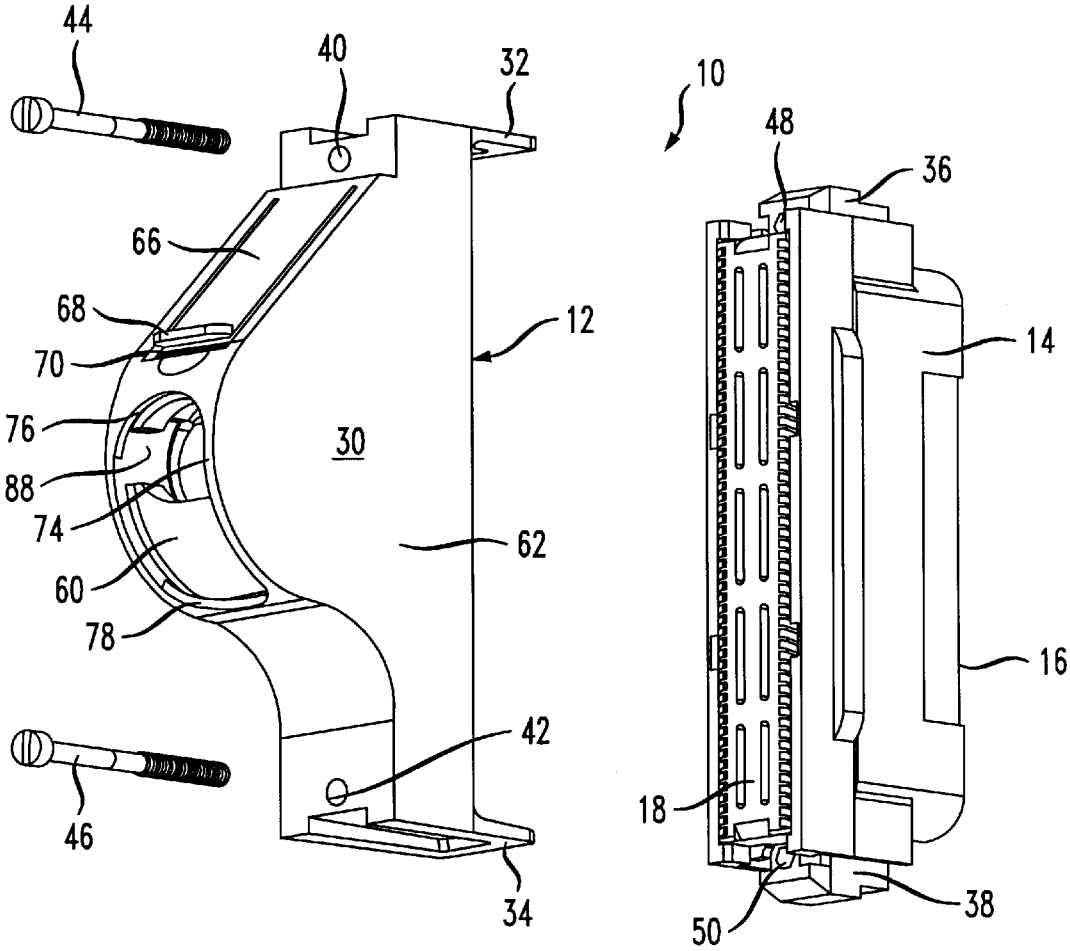
FIG. 1 is a perspective, assembly view of a connector with an adjustable cable egress mechanism according to the invention.

FIG. 1 is a perspective view of a connector 10 with an adjustable cable egress mechanism 12 according to the invention. The connector 10 has a generally rectangular, elongated connector body 14. The connector body 14 has a terminal face 16 at a front side of the body for engaging terminals of a mating connector (not shown). The connector body may be, for example, that of a commercially available 25-pair cable plug connector meeting FCC rules, Part 68, Subpart F, for 50-pin miniature ribbon connectors. The invention is not limited with respect to a particular connector body, and may be applied in other types of electrical connectors as well as in connectors for optical fiber cables.

As is generally known in the art, cable conductors in the form of insulated wires (or fibers) may be terminated inside the connector body 14. The wires are individually routed or "dressed" over a cable end face 18 of the connector body 14, so that the wires diverge neatly and evenly from an end of a jacketed cable into the connector cable end face 18.

The cable egress mechanism 12 comprises a hood or shell 30 for protectively enclosing individual wires dressed over the end face 18 of the connector body 14, as well as the end of the jacketed cable from which the wires diverge. Hood 30 may, for example, be molded from a plastics material meeting all applicable standards with respect to electrical insulation and flammability. Suitable materials include, e.g., polycarbonate, ABS, and blends thereof. A typical wall thickness of the hood 30 is about 0.050 inches. A front portion of the hood 30 has an opening with a cross section that conforms to the periphery of the cable end face 18 on the connector body 14.

A pair of resilient loop snaps, 32, 34, project from both side ends of the front portion of the hood 30. The snaps 32, 34, have openings for engaging corresponding block protrusions 36, 38, at opposite side ends of the connector body 14. The hood 30 also has a pair of fastener openings 40, 42, formed in the vicinity of the loop snaps 32, 34. The openings 40, 42, permit a pair of connector screws 44, 46, to be inserted from outside the hood 30, and to pass through corresponding openings 48, 50, in opposite side ends of the connector body 14. Threaded ends of the connector screws 44, 46, may then engage corresponding threaded openings in the body of a mating connector, and both of the screws tightened from the cable end face side of the connector body 14 to fasten the connector 10 on the mating connector.

A cable supporting and indexing hub 60 is mounted for rotation within the hood 30. See also FIGS. 2 and 3. The hub 60 is in partially cylindrical form, and has a hub axis A. The hub 60 is mounted between opposed walls 62, 64, within a central portion of the connector hood 30 as viewed in FIG. 1. See also FIG. 4. A part of the hood 30 which extends tangentially off the hub 60, forms a resilient indexing spring finger or latch 66. The latch 66 also has an indexing pawl 70 protruding from a free end of the latch, toward the circumference of the hub 60. See FIG. 5.

Latch 66 may be thicker at its base where it joins the body of the hood 30, and the thickness of the latch 66 may taper narrower in the direction toward its free end. Thus, the latch 66 can be urged by applying a finger force to a lip 68 at the free end, in a direction away from the hub 60 (see FIG. 5).

Figure 4:
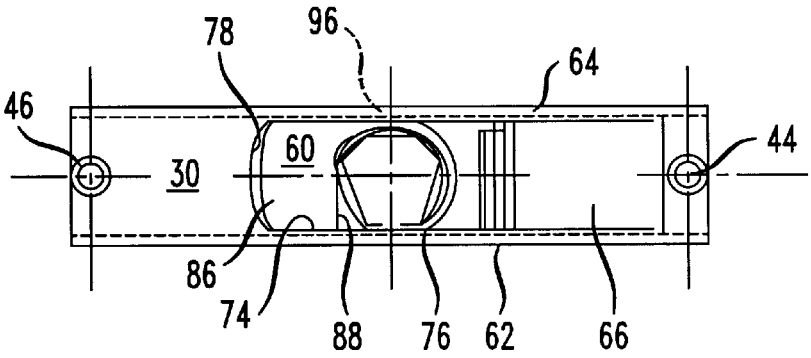
FIG. 4 is an end view of the connector as seen from the front in FIG. 1 in an assembled state, showing a cable exiting the connector at a "straight away" angle of 180 degrees.
Figure 5:
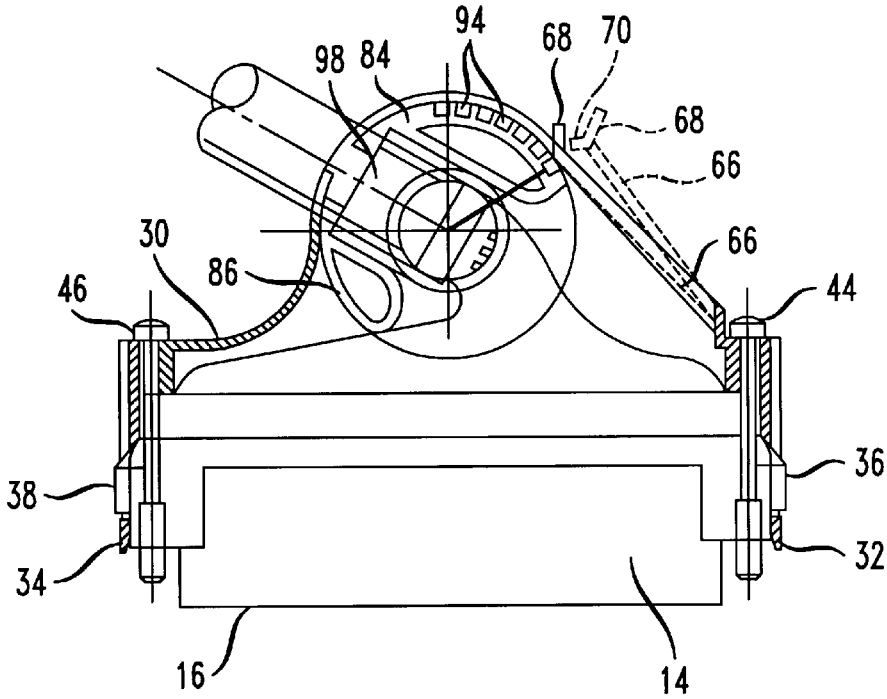
FIG. 5 is a side view of the assembled connector, showing a cable exiting the connector at an angle of about 110 degrees.
Figure 7:
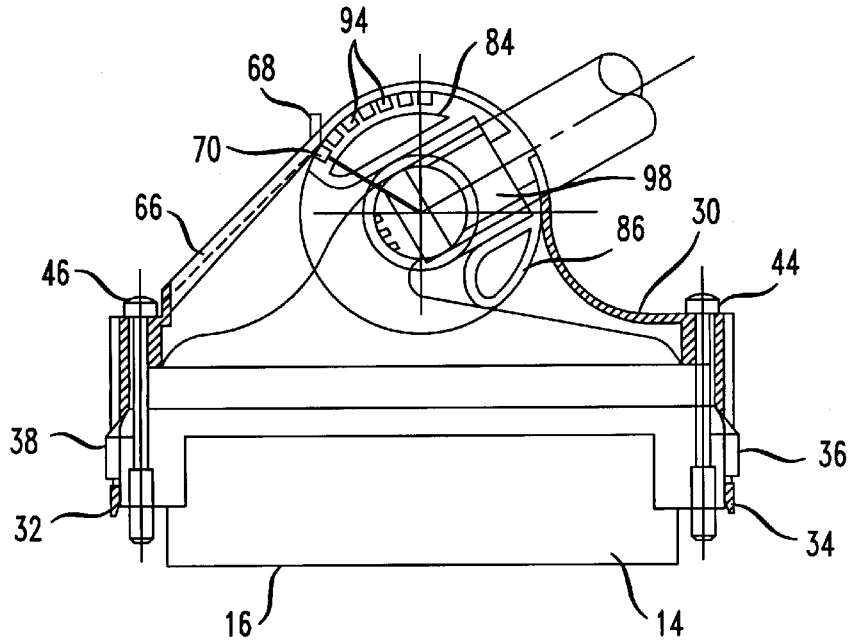
FIG. 7 is a side view of the assembled connector, showing a cable exiting the connector at an angle of about 240 degrees.

The rear end wall of the hood 30 also has an elongated cable egress slot 74, which slot is formed to subtend a determined arc about the hub axis A when the hub 60 is mounted within the hood. For example, one end 76 of the slot 74 may define a position at which a cable exits from the connector 10 at the 180-degree position shown in FIG. 4. An opposite end 78 of the slot may define a position at which the cable egresses at an angle of either 110 degrees or 240 degrees, as shown in FIGS. 5 and 7. The slot 74 also allows the cable to be set to egress at angles intermediate those defined by the slot ends 76, 78.

Figure 2:
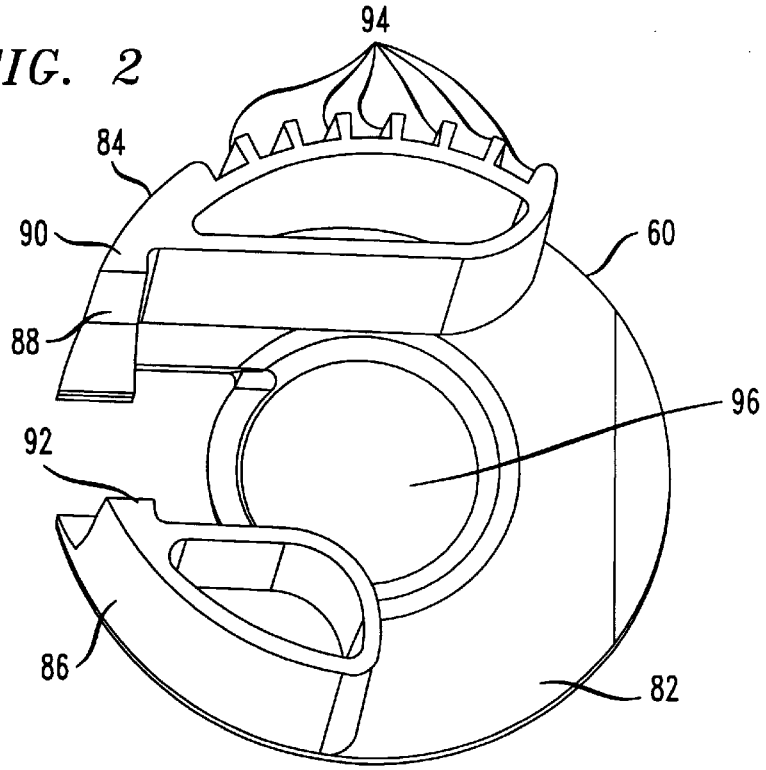
FIG. 2 is an enlarged perspective view of a cable indexing or positioning hub in the mechanism of FIG. 1.
Figure 3:
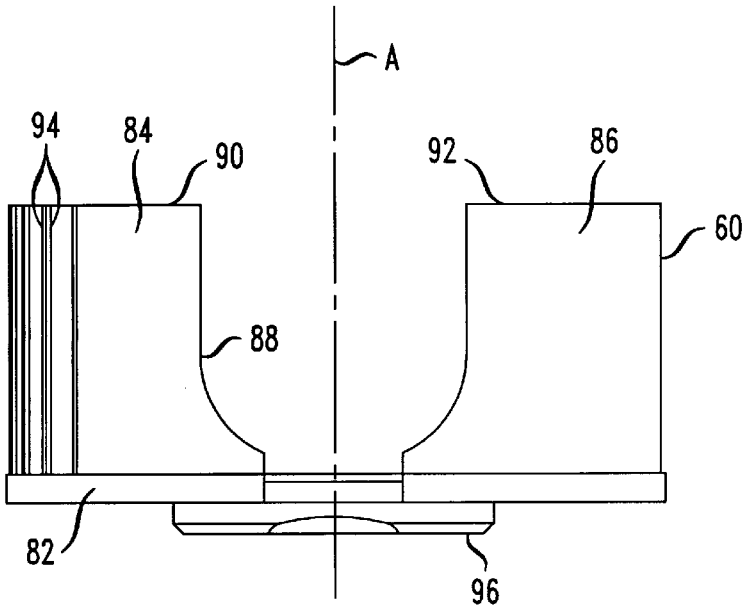
FIG. 3 is an elevational view of the hub as seen from the left in FIG. 2.

FIGS. 2 and 3 show further details of the hub 60 in the cable egress mechanism 12. The hub 60 has a generally disk-shaped base 82, and two partial circumferential walls 84, 86. The two walls 84, 86, and the base 82 define a cable passage 88 through the hub 60. That is, the cable passage 88 lies above the hub base 82 and is substantially perpendicular to the hub axis A. As viewed in FIG. 2, a left end of the cable passage 88 is bordered by opposed, circumferentially spaced extensions 90, 92, from the hub walls 84, 86. Opposed edges of the wall extensions 90, 92, are spaced by an amount sufficient to permit sliding movement of a cable along the direction of the passage 88, and to restrain a cable end collar 98 (see FIGS. 5–7) which collar may be crimped about the cable end jacket near the cable end face 18 of the connector body 14. Thus, the wall extensions 90, 92, cooperate with the cable end collar to provide strain relief for cable wires dressed over the end face 18 of the connector body 14, should the cable be pulled from outside the hood 30.

Hub wall 84 also has a number of indexing grooves 94 in its circumference. Each of the grooves 94 extends parallel to the hub axis A (see FIG. 3) and is of such dimensions as to receive and to seat the pawl 70 at the free end of the indexing latch 66, when the hub 60 is rotated to align one of the grooves 94 with the latch pawl 70. In the illustrated embodiment, seven equi-circumferentially spaced grooves 94 are formed in the circumference of the hub wall 84, so that the support hub 60 may be rotated to a selected one of seven angular positions when the hub is mounted within the connector hood 30, and the pawl 70 is seated in the corresponding groove in the hub wall.

The support hub 60 also has a cylindrical boss 96 that projects coaxially from the bottom of the hub base 82, as viewed in FIG. 3. The boss 96 is arranged to be seated for pivotal movement within a corresponding circular cutout in the hood wall 64 (see FIG. 4). The boss 96 thus allows the hub 60 to pivot for rotation between the opposed side walls 62, 64, of the connector hood 30. With the hub 60 mounted for rotation inside the connector hood 30, the cable passage 88 through the hub will open into the cable egress slot 74 in the hood 30, at each position of the hub 60 where the latch pawl 70 may be seated in one of the indexing grooves 94 on the circumference of the hub wall 84.

Assembly of the connector 10 with wires or fibers emerging from a cable end, proceeds as follows. Before terminating cable wires in the connector body 14, the cable egress mechanism 12 comprising hood 30 and hub 60 is adjusted so that the supporting hub 60 is at the 180 degree (cable straightaway) position in FIG. 4. The cable end is inserted through the cable egress slot 74 in the hood 30, between the hub wall extensions 90, 92, and through the cable passage 88 between the walls 84, 86 of the hub. The entire mechanism 12 is then slid along the jacketed cable, out of the way of cable wires to be terminated in the connector body 14. The cable wires are then terminated and laced in and about the connector cable end face 18, with the jacketed cable extending in the 180 degree position.

The cable end collar 98 is crimped about the cable jacket near the position where the jacket is removed, to allow the cable wires to diverge and terminate in the connector body 14. The egress mechanism 12 is then slid back down the cable, and the loop snaps 32, 34, on the hood 30 are snapped onto the protrusions 36, 38, on the connector body.

Figure 6:
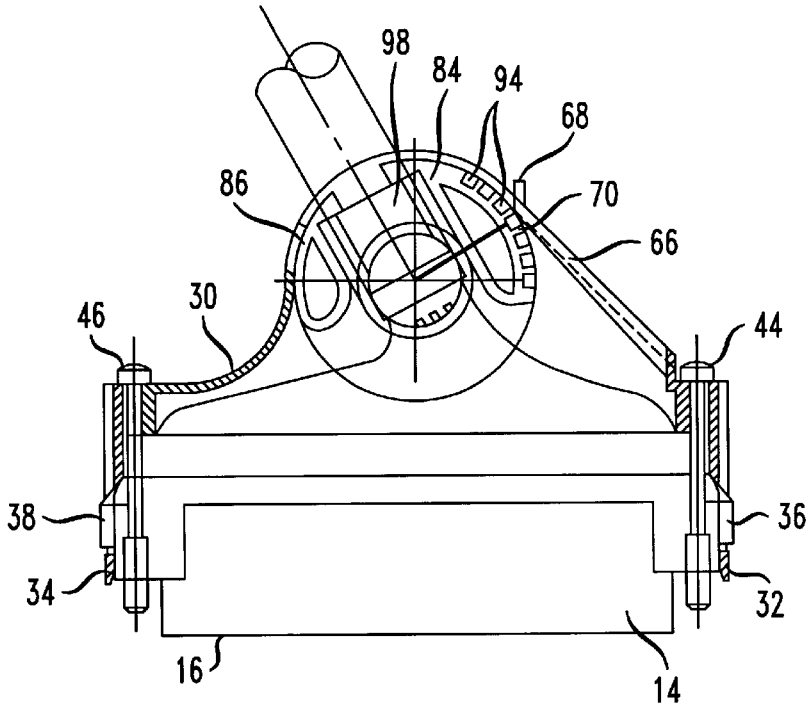
FIG. 6 is a side view of the assembled connector, showing a cable exiting the connector at an angle of about 150 degrees.

After fastening the connector hood 30 on the connector body 14 via the loop snaps 32, 34, a desired angle of cable egress may be set by urging the pawl 70 of the indexing latch 66 away from the hub 60, and rotating the cable to the desired position by as much as, for example, 30 degrees from horizontal. FIG. 5 shows cable egress at 110 degrees, i.e., 30 degrees above horizontal at the left side of FIG. 5. FIG. 6 shows a left-side egress at an angle of about 150 degrees, or 60 degrees above horizontal at the left side of the connector 10 in FIG. 6. FIG. 7 shows cable egress at 240 degrees, i.e., 30 degrees above horizontal at the right side of connector 10 in FIG. 7.

The cable egress slot 74 in the hood 30 should face the desired direction of cable egress. In the disclosed embodiment, the hood 30 is "reversible" as shown by FIGS. 5 and 7. That is, the cable egress mechanism 12 may be removed from the connector body 14 by unfastening the screws 44, 46, releasing the hood snaps 32, 34, flipping the hood 180 degrees about the cable axis, and re-fastening the hood to the connector body. This feature allows the cable egress slot 74 to extend along the hood in only one direction from the slot end 76 which corresponds to the 180 degree cable egress position in FIG. 4.

While the foregoing description represents a preferred embodiment of the invention, it will be obvious to those skilled in the art that various changes and modifications may be made without departing from the scope of the invention which is pointed out by the following claims. For example, in place of the illustrated latching mechanism, a conventional releaseable friction clutch may be arranged between the hood 30 and the rotatable hub 60, to allow a cable terminated in the connector body 14 to be moved and set at a desired angle relative to the connector body.

We claim:

1. An adjustable cable egress mechanism for cable connectors, comprising:

a protective hood; and a generally cylindrical hub mounted within said hood for rotation about a hub axis, said hub having a circumference and a cable passage that opens on the circumference of the hub;

wherein said hood has an outside wall with a cable egress slot formed to open into the cable passage in the hub over a predetermined range of angular positions of the hub about said hub axis, so that an outside cable passing through the cable egress slot in the hood and supported in the cable passage in said hub, can be rotated with the hub about said axis to a desired egress angle within said predetermined range; and a part of the hood includes a releasable mechanism that is arranged to engage the circumference of the hub at the desired egress angle.

2. A cable egress mechanism according to claim 1, wherein said hub comprises a generally disk-shaped base and two hub walls extending from said base, said base and said hub walls define said cable passage.

3. A cable egress mechanism according to claim 2, wherein opposed edges of said hub walls are spaced by an amount sufficient to permit sliding movement of an outside cable along said passage while restraining movement of an end collar when crimped about said cable.

4. A cable egress mechanism according to claim 2, wherein said hub has a boss that projects coaxially to seat in a corresponding opening in said hood, for pivoting the hub for rotation inside said hood.

5. A cable egress mechanism according to claim 1, wherein the releasable mechanism includes a resilient spring finger or latch.

6. An adjustable cable egress mechanism for cable connectors, comprising:

a protective hood;

a hub mounted within said hood for rotation about a hub axis, said hub having a cable passage;

wherein said hood has an outside wall with a cable egress slot formed to open into the cable passage in the hub over a predetermined range of angular positions of the hub about said hub axis, so that an outside cable passing through the cable egress slot in the hood and extending in the cable passage in said hub, can be rotated with the hub about said axis and supported by said hub at a desired egress angle within said predetermined range;

a latch associated with the hood, wherein the latch is constructed and arranged to engage the hub at the desired egress angle and the latch comprises a resilient finger part on the hood; and wherein said hub has a number of axially extending grooves in its outer periphery, and said latch has a pawl arranged to be seated in a selected one of said grooves.

7. A cable connector, comprising:

a connector body having a terminal face for engaging terminals of a mating connector, and a cable end face for terminating cable conductors diverging from a cable end of an outside cable;

a hood constructed and arranged for protectively enclosing said conductors and said cable end in the region of the end face of the connector body; and a generally cylindrical hub mounted within said hood for rotation about a hub axis, said hub having a circumference and a cable passage that opens on the circumference of the hub;

wherein said hood has an outside wall with a cable egress slot formed to open into the cable passage in the hub over a predetermined range of angular positions of the hub about said hub axis, so that an outside cable passing through the cable egress slot in the hood and supported in the cable passage in said hub, can be rotated with the hub about said axis to a desired egress angle within said predetermined range; and a part of the hood includes a releasable mechanism that is arranged to engage the circumference of the hub at the desired egress angle.

8. A cable connector according to claim 7, wherein said hub comprises a generally disk-shaped base and two hub walls extending from said base, and said base and said hub walls define said cable passage.

9. A cable connector according to claim 8, wherein opposed edges of said hub walls are spaced by an amount sufficient to permit sliding movement of an outside cable along said passage while restraining movement of an end collar when crimped about the cable.

10. A cable connector according to claim 8, wherein said hub has a boss that projects co-axially to seat in a corresponding said hood, for pivoting the hub for rotation inside the hood.

11. A cable connector according to claim 7, wherein the mechanism is a releasable spring finger or latch.

12. A cable connector, comprising:

a connector body having a terminal face for engaging terminals of a mating connector, and a cable end face for terminating cable conductors diverging from a cable end of an outside cable;

a hood constructed and arranged for protectively enclosing said conductors and said cable end in the region of the end face of the connector body;

a hub mounted within said hood for rotation about a hub axis, said hub having a cable passage;

wherein said hood has an outside wall with a cable egress slot formed to open into the cable passage in the hub over a predetermined range of angular positions of the hub about said hub axis, so that an outside cable passing through the cable egress slot in the hood and extending in the cable passage in said hub, can be rotated with the hub about said axis and supported by said hub at a desired egress angle within said predetermined range;

a latch associated with the hood, wherein said latch is constructed and arranged to engage the hub at the desired egress angle, and the latch comprises a resilient finger part on said hood; and wherein said hub has a number of axially extending grooves in its outer periphery, and said latch has a pawl arranged to be seated in a selected one of said grooves.

13. A cable assembly, comprising:

a length of cable having a cable end, and a number of cable conductors diverging from the cable end;

a connector body having a terminal face for engaging terminals of a mating connector, and a cable end face for terminating the cable conductors from the cable end;

a hood constructed and arranged for protectively enclosing said conductors and said cable end near the end face of the connector body;

a generally cylindrical hub mounted within said hood for rotation about a hub axis, said hub having a circumference and a cable passage that opens on the circumference of the hub;

wherein said hood has an outside wall with a cable egress slot formed to open into the cable passage in the hub over a predetermined range of angular positions of the hub about said hub axis, and said cable passes through the cable egress slot in the hood and is supported in the cable passage in said hub so that the cable can be rotated with the hub about said hub axis to a desired egress angle within said predetermined range; and a part of the hood includes a releasable mechanism that is arranged to engage the circumference of the hub at the desired egress angle.

14. A cable assembly according to claim 13, wherein said hub comprises a generally disk-shaped base and two hub walls extending from said base, and said base and said hub walls define said cable passage.

15. A cable assembly according to claim 14, wherein opposed edges of said hub walls are spaced by an amount sufficient to permit sliding movement of said cable along said passage while restraining movement of an end collar when crimped about said cable.

16. A cable assembly according to claim 14, wherein said hub has a boss that projects coaxially to seat in a corresponding opening in said hood, to pivot said hub for rotation inside the hood.

17. A cable assembly according to claim 13, wherein the releasable mechanism includes a resilient spring finger or latch.

18. A cable assembly, comprising:

a length of cable having a cable end, and a number of cable conductors diverging from the cable end;

a connector body having a terminal face for engaging terminals of a mating connector, and a cable end face for terminating the cable conductors from the cable end;

a hood constructed and arranged for protectively enclosing said conductors and said cable end near the end face of the connector body;

a hub mounted within the hood for rotation about a hub axis, the hub having a cable passage;

wherein the hood has an outside wall with a cable egress slot formed to open into the cable passage in the hub over a predetermined range of angular positions of the hub about the hub axis, and said cable passes through the cable egress slot in the hood and extends in the cable passage in the hub so that the cable can be rotated with the hub about the hub axis and supported by the hub at a desired egress angle within said predetermined range;

a latch associated with the hood, wherein the latch is constructed and arranged to engage the hub at the desired egress angle, and the latch comprises a resilient finger part on the hood; and wherein said hub has a number of axially extending grooves in its outer periphery, and said latch has a pawl arranged to be seated in a selected one of said grooves.

19. An adjustable cable egress mechanism for cable connectors, comprising:

a protective hood dimensioned and formed for enclosing a cable end face of a connector body, the hood including a front portion having a cross section that conforms to the cable end face of the connector body and a rear end wall;

a generally cylindrical hub mounted within said hood for rotation about a hub axis, said hub having a cable passage that opens gn the circumference of the hub;

wherein the rear end wall of said hood has a cable egress slot formed to subtend a determined arc about the hub axis between a first slot end and a second slot end so that the egress slot opens into the cable passage in the hub over a predetermined range of angular positions of the hub about said hub axis, and an outside cable passing through the cable egress slot in the hood and supported in the cable passage in said hub, can be rotated with the hub about said axis to a desired egress angle within said predetermined range between the first and the second slot ends of the egress slot in the hood; and a releasable mechanism fixed on said hood for restraining the hub at the desired egress angle.

20. A cable egress mechanism according to claim 19, wherein the releasable mechanism comprises a resilient finger or latch for engaging a circumferential wall of the hub at the desired egress angle.

21. A cable connector, comprising:

a connector body having a terminal face for engaging terminals of a mating connector, and a cable end face for terminating cable conductors diverging from a cable end of an outside cable;

a hood constructed and arranged for protectively enclosing said cable conductors and said cable end face of the connector body, the hood including a front end portion having a cross section that conforms to said cable end face, and a rear end wall;

a generally cylindrical hub mounted within said hood for rotation about a hub axis, said hub having a cable passage that opens on the circumference of the hub;

wherein the rear wall of said hood has a cable egress slot formed to subtend a determined arc about the hub axis between a first slot end and a second slot end so that the egress slot opens into the cable passage in the hub over a predetermined range of angular positions of the hub about said hub axis, and an outside cable passing through the cable egress slot in the hood and supported in the cable passage in said hub, can be rotated with the hub about said axis to a desired egress angle within said predetermined range between the first and the second slot ends of the egress slot in the hood; and a releasable mechanism fixed on said hood for restraining the hub at the desired egress angle.

22. A cable connector according to claim 21, wherein the releasable mechanism comprises a resilient spring finger or latch for engaging a circumferential wall of the hub at the desired egress angle.

23. A cable assembly, comprising:

a length of cable having a cable end, and a number of cable conductors diverging from the cable end;

a connector body having a terminal face for engaging terminals of a mating connector, and a cable end face for terminating the cable conductors from the cable end;

a hood constructed and arranged for protectively enclosing said cable conductors and said cable end face of the connector body, the hood including a front portion having a cross section that conforms to the cable end face of the connector body and a rear end wall;

a generally cylindrical hub mounted within said hood for rotation about a hub axis, said hub having a cable passage that opens on the circumference of the hub;

wherein the rear end wall of said hood has a cable egress slot formed to subtend a determined arc about the hub axis between a first slot end and a second slot end so that the egress slot opens into the cable passage in the hub over a predetermined range of angular positions of the hub about said hub axis, and said cable passes through the cable egress slot in the hood and is supported in the cable passage in said hub so that the cable can be rotated with the hub about said hub axis to a desired egress angle within said predetermined range between the first and the second slot ends of the egress slot in the hood; and a releasable mechanism fixed on said hood for restraining the hub at the desired egress angle.

24. A cable assembly according to claim 23, wherein the releasable mechanism comprises a resilient spring finger or latch for engaging a circumferential wall of the hub at the desired egress angle.

* * * * *